United States Patent [19]

Straub

[11] 4,009,501

[45] Mar. 1, 1977

[54] STREET AND PEDESTRIAN ZONE CLEANING MACHINE

[76] Inventor: Johannes Straub, Fussener Strasse 32, 8950 Kaufbeuren, Germany

[22] Filed: Mar. 3, 1975

[21] Appl. No.: 554,441

[30] Foreign Application Priority Data

July 26, 1974 Germany ..... 2436114

[52] U.S. Cl. ..... 15/84

[51] Int. Cl.[2] ..... E01H 1/04

[58] Field of Search ..... 15/44, 79 R, 79 A, 83–87, 15/340, 350, 353

[56] References Cited

UNITED STATES PATENTS

| | | | |
|---|---|---|---|
| 1,097,833 | 5/1914 | Yochem | 15/44 |
| 3,160,908 | 12/1964 | Peabody et al. | 15/340 |
| 3,484,889 | 12/1969 | McCandless | 15/340 |

FOREIGN PATENTS OR APPLICATIONS

| | | | |
|---|---|---|---|
| 1,112,147 | 5/1968 | United Kingdom | 15/340 |

*Primary Examiner*—Edward L. Roberts
*Attorney, Agent, or Firm*—Strauch, Nolan, Neale, Nies & Kurz

[57] ABSTRACT

A machine for the cleaning of streets and in particular, the cleaning of pedestrian zones. The dust from the street is directed against a damp cloth by means of a rotating brush; the cloth is a partially permeable water sack on which the dust collects in scale-like masses. The scales fall from the sack and are thrown by brushes into a receiving means. The machine functions without a dust vacuum and therefore is relatively quiet.

10 Claims, 19 Drawing Figures

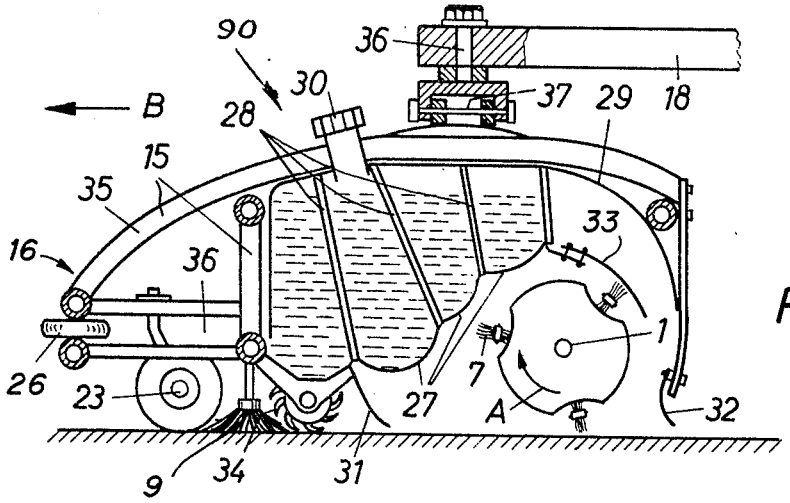
Fig.1
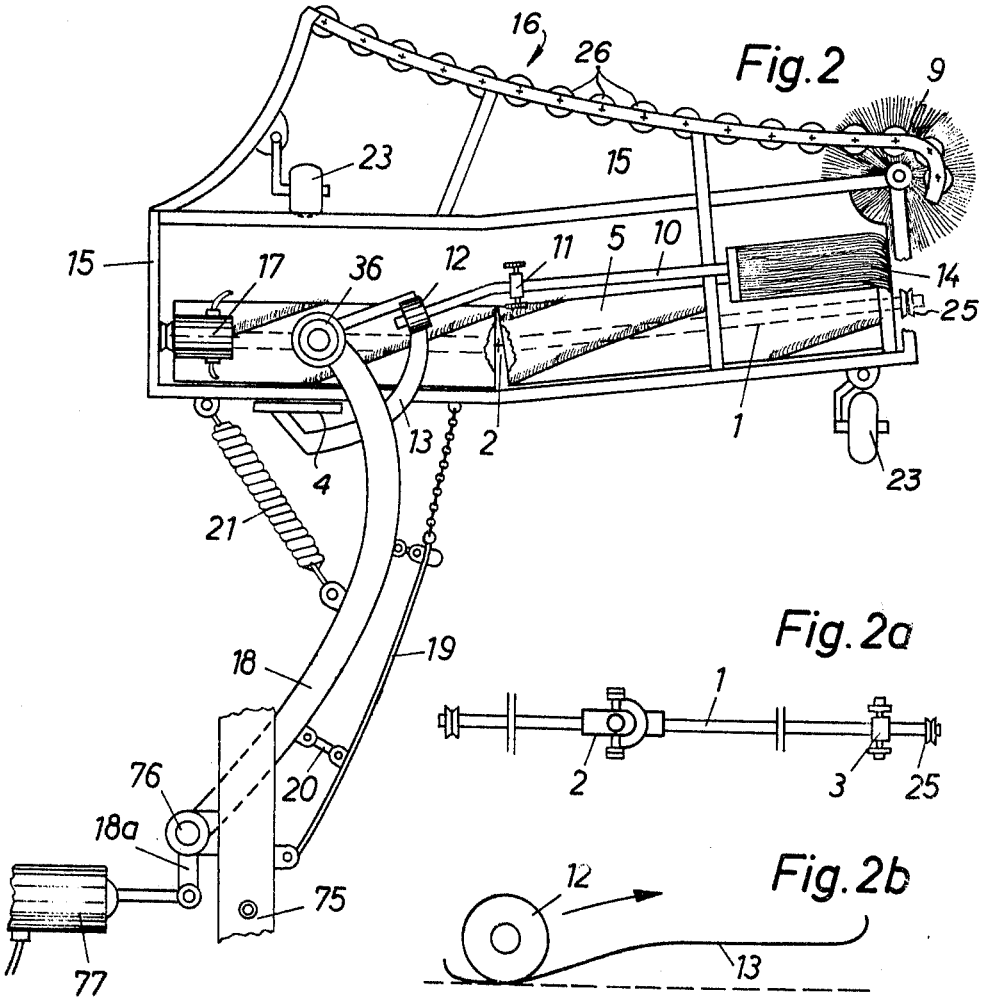
Fig.2
Fig.2a
Fig.2b

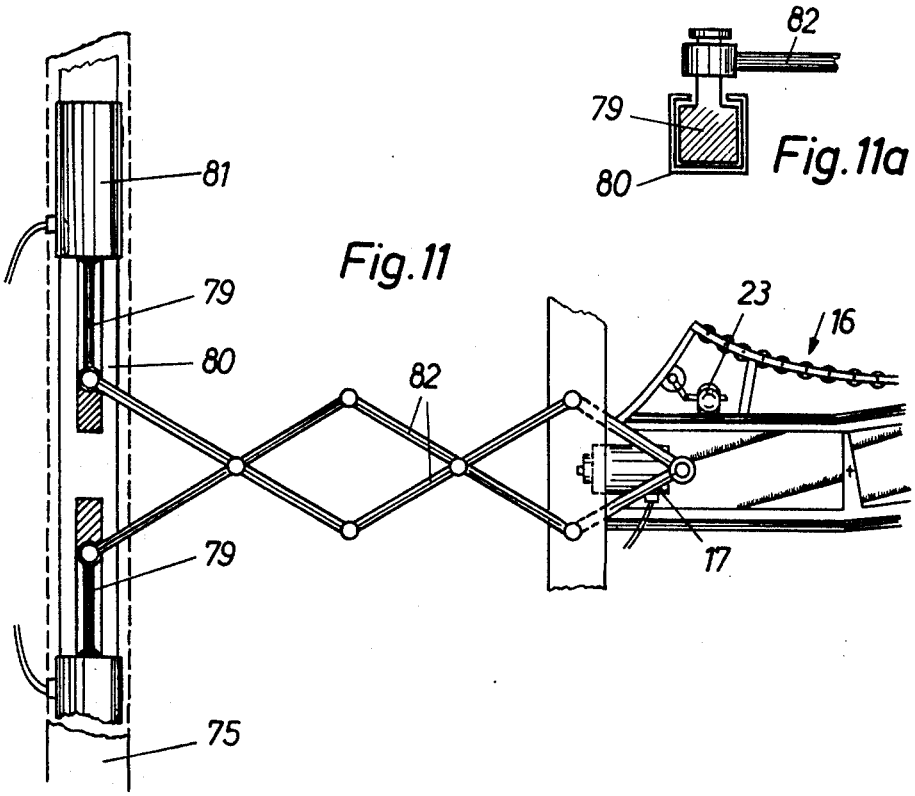
Fig.11
Fig.11a
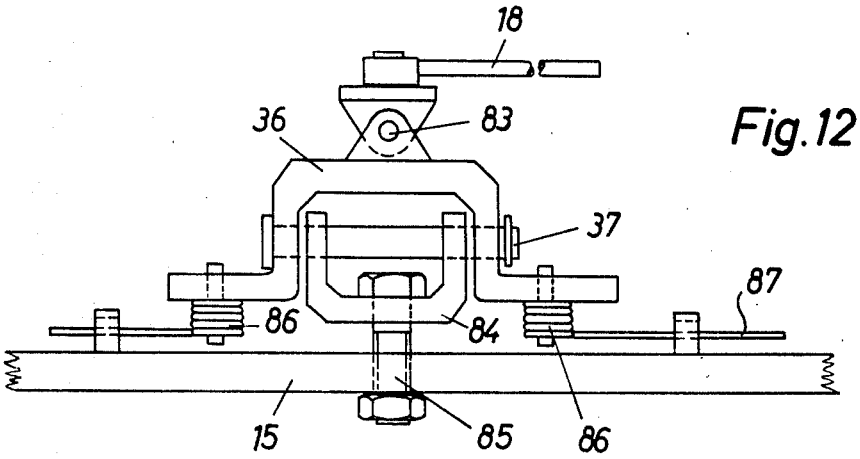
Fig.12

STREET AND PEDESTRIAN ZONE CLEANING MACHINE

BACKGROUND

The invention relates to a self-propelled street cleaning machine adapted for cleaning relatively wide sections of pavement.

Street cleaning machines are known in the art, however, these machines, in general, utilize vacuum arrangements which are used to collect the dust which is swept by the brushes. One important problem with these machines is that they are relatively noisy due to the vacuum arrangement.

One can observe that the rubbish on streets having a relatively heavy flow of traffic collects at the edges thereof while the center of the street remains relatively clean. For this reason, the prior art machines are constructed to clean only relatively narrow widths, since only the side portions of the street have to be cleaned.

Also, with the current trend towards the use of pedestrian zones, street cleaning problems take on new dimensions. As the air current causing the rubbish to accumulate automatically in the afore described manner as a result of the passing vehicles is not existent in pedestrian zones, it is necessary to clean the entire pavement of a pedestrian zone. The prior art cleaning machines, because of their relatively narrow cleaning paths, are not adapted for large pedestrian zones. Further, pedestrian zones contain many obstacles, such as flower arrangements, goods displays and lighting facilities. If the pedestrian zones were cleaned with the conventional street cleaning machines more or less untouched areas, in particular corners and recesses, would remain.

The problem posed by the size of pedestrian zones could not be overcome simply by increasing the size of the street cleaning machine, since an increase in size would entail increase in the size of the vacuum arrangement which would, in turn, increase the noise. It would, on the other hand, be difficult to collect the rubbish without a vacuum.

It is therefore, an object of this invention to provide a street cleaning machine which is adapted for cleaning relatively wide sections of the pavement without causing undue amounts of noise. This object is accomplished in that a damp cloth or sack is arranged near the sweeping brushes. The sweeping brushes throw the dust against the damp sack where it collects and then falls in the form of scales. These scales are then swept by the sweeping brushes in the direction of a receptacle arrangement where they are then swept up, placed on a conveyor, and led to a container. The sweeping brushes are arranged in a twisted or spiral arrangement so that the scales will move along the revolving sweeping brushes in the proper direction, i.e. the direction of the receptacle arrangement. The cloth can be kept damp by carrying water somewhat like a wick, the cloth being attached to a liquid supply or preferably, the cloth can be a portion of a water permeable liquid container, e.g. a linen sack filled with water. The area of the machine which contains the cleaning apparatus is enclosed by skirts in order to prevent the undue distribution of dust. The dust is brushed against the damp cloth, collects there, and finally falls as scales which are collected by a receptacle arrangement.

It is another object of this invention to have a cleaning machine which is highly maneuverable and which can operate easily on a surface replete with obstacles.

It is another object of this invention to provide a machine which, although being capable of cleaning wide sections of pavement, is relatively narrow and can be kept in small garages as well as being capable of traveling down narrow paths. Other objects will become apparent in the following description.

FIG. 1 is a cross-section of a portion of the machine showing the water sack and the brush cylinder.

FIG. 2 shows a top plan view of the cleaning arrangement of FIG. 1 pivotally mounted on a carrier.

FIG. 2*a* shows details of a brush cylinder drive shaft having a cross-link.

FIG. 2*b* shows the lowering arrangement for a flat brush.

Figure 3:
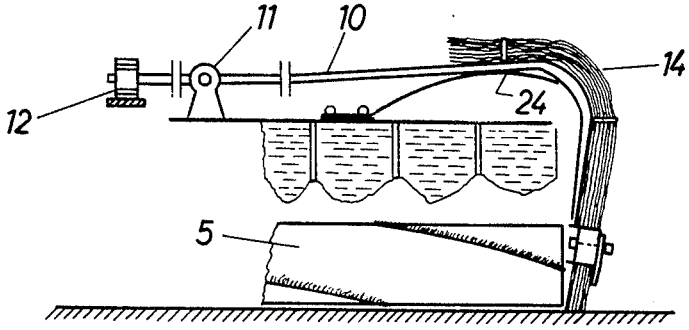

FIG. 3 is a rear detail view of the arrangement shown in FIG. 1.

Figure 4:
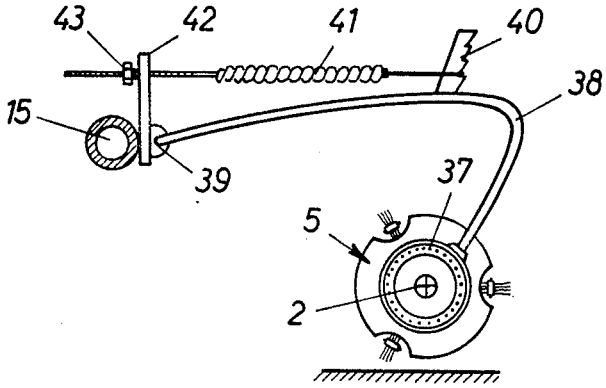

FIG. 4 shows details of a suspension arrangement for the brush cylinder.

Figure 5:
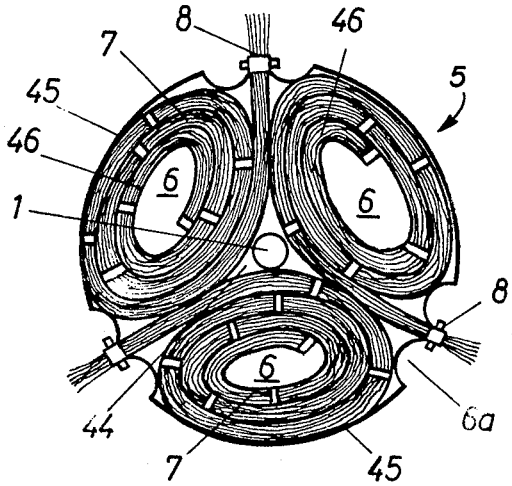

FIG. 5 shows a cross-section of the brush cylinder.

Figure 6:
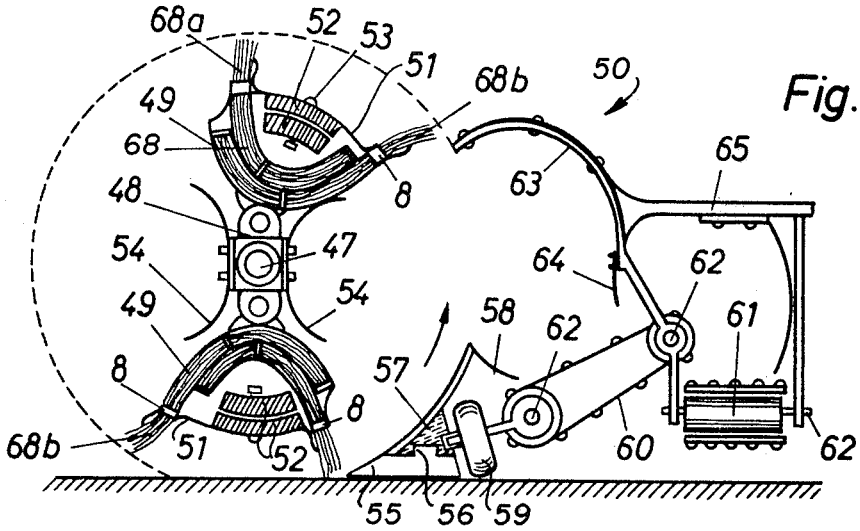

FIG. 6 is a cross-section of another component of the sweeping machine, which shows a brushing arrangement as well as a receptacle arrangement.

Figure 7:
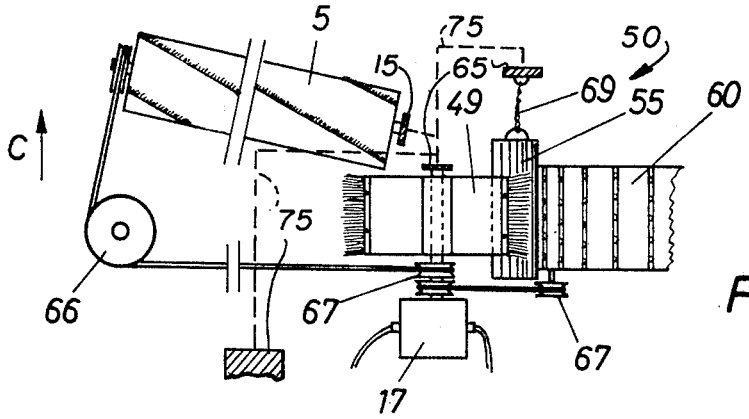

FIG. 7 shows the FIG. 6 brushing arrangement and receptacle arrangement from above together with a brush cylinder of a cleaning arrangement similar to that shown in FIG. 1.

Figure 8:
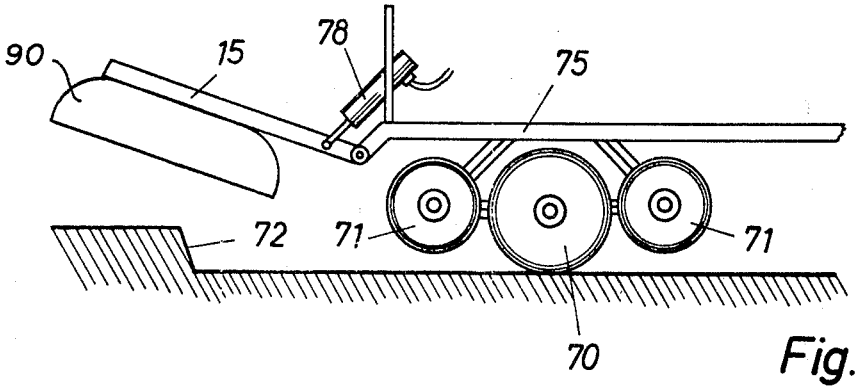

FIG. 8 shows a forward wheel arrangement of the machine.

Figure 9A:
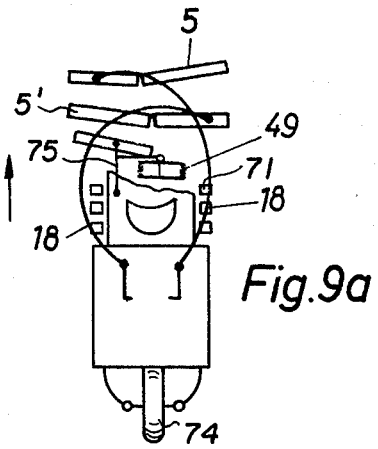
Figure 9B:
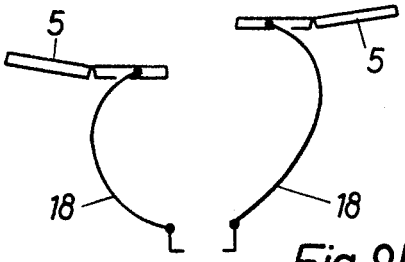
Figure 9C:
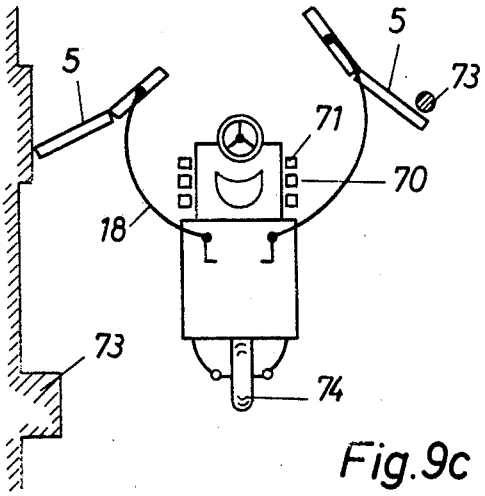

FIGS. 9*a* through 9*c* are schematic showings of the machine illustrating the extensible sweeping arrangement.

Figure 10A:
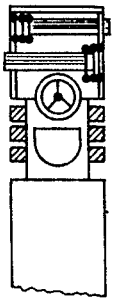
Figure 10B:
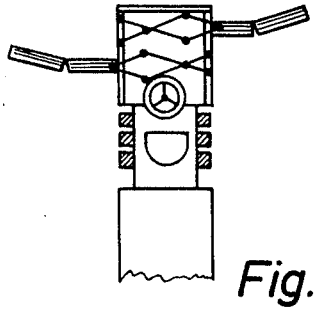
Figure 10C:
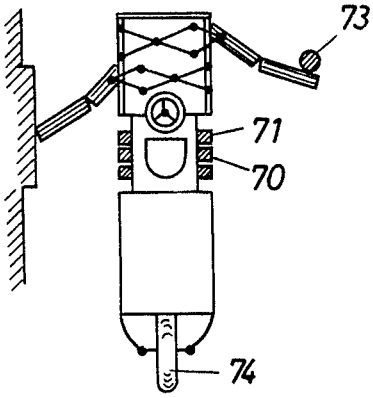

FIGS. 10 through 10*c* show another embodiment for the attaching of the sweeping arrangement to the machine chassis.

FIGS. 11 and 11*a* show details of the attachment structure for the sweeping arrangement in the machine shown in FIG. 10*a* through 10*c*.

FIG. 12 shows details of the suspension of the sweeping arrangement from its carrier.

Referring to the Figures, FIG. 1 shows a cross-section of a basic cleaning arrangement portion 90 of the cleaning machine constructed in accordance with the invention. There is shown a brush cylinder 5 which is driven by a driving axle 1; the brush cylinder 5 has three brush bundles 7 which extend therefrom. The brush cylinder 5 rotates in a direction shown by arrow A while the machine travels in the direction shown by arrow B. The brushes 7 revolve over the sections of the street to be cleaned and throw the dust in the direction of water sack 27 which is made of a water permeable material, e.g. linen or artificial material. The only portion of the water sack 27 which needs to be permeable is that which is adjacent the brushes 7. This water sack 27 is fixed by means of elastic bands 28, made from, for example, rubber, and attached to frame 15. The water sack can be filled by means of input 30. The dust attaches itself to the damp surface of the water sack 27 and collects thereon. As soon as the collected dust becomes heavy enough, it falls in scales before the brushes. Because of the movement of the water in the water sack, the underside of this sack will be continuously kept in movement. This sack is, as previously mentioned, preferably fixed by a plurality of elastic rubber holding means, the movement caused by the traveling of the machine causing this arrangement to maintain a shaking movement adapted to dislodge the scales. The fallen scales of dust are carried by the twisted brushes of the brush cylinder 5 to an appropriate recepticle arrangement (not shown in FIG. 1). The phrase twisted brushes means that each brush row 7 twists or spirals along the surface of the brush cylinder 5 (see FIGS. 2, 3 and 7).

The frame 15 is supported by a roll 23 and hangs from a carrier 18 by means of a bearing 37 which is turnable about a bearing 36. The arrangement also includes forward rubber apron 31 and a rear rubber apron 32 which enclose areas in which the brush cylinder operates. Side aprons are also included but not shown in FIG. 1. In front of the forward apron 31 is a rubber roller 34 which presses down those bulky items such as cigarette packages so that this type of rubbish will be able to pass under the forward apron 31. A dragging flap 33 is arranged above the brush cylinder 5 near the water sack 27 which causes the space between the cylinder 5 and the water sack which is filled with dust to be held to another relatively small dimensions in order to increase the dust collection on water sack 27. A rear hood 29 serves to further enclose the dust collection space. A bumper 16 is arranged on the support structure 15, the bumper being equipped with rollers 26 which allow the machine to slide by various obstacles. There is no danger that the pores of the water sack will be clogged since the pores will be kept open by the water which continuously seeps therethrough.

FIG. 2 shows a plan view of an arrangement of FIG. 1 mounted on a laterally swingable arm 19, the water sack 27 not being shown. The bearing 76 which is arranged on the machine chassis 75 is pivotally supported with respect to the carrier 18. A pneumatic or hydraulic mechanism 77 engages the end 18*a* of the carrier 18, the operation of which allows the carrier to be swung away from the chassis 75. A guiding rod 19 turns parallel to the carrier 18, rod 19 having a link 20; the rod 19 is connected by means of a chain with the frame 15 and ensures that the direction of the frame 15 will be maintained when the carrier 18 is swung. A spring 21 biases the frame 15 about the pivot 36 to a position against an abutment 4. FIG. 2 shows a hydraulic motor 17 for the cylinder 5, which cylinder is divided into sections. This cylinder 5 is divided approximately in the middle so that a cross-link 2 in the drive shaft 1 produces a driving connection to the outer brush portions. This dividing is of utility when the pavement to be cleaned is uneven. The details of the driving axis for the brush cylinder are shown in FIG. 2*a*. FIG. 2*b* shows the driving axis for the brush cylinder with a cross-link, the outer end of the driving axis 1 being movably led to bearing 3. At the end of the drive shaft 1 is arranged a pulley 25 over which a belt (not shown) is led for driving a round brush 9 which is provided at the edge of frame 15 and serves for the cleaning of corners.

An adjustable flat brush 14 is also provided and is attached to lever 10, brush 14 reaching almost to the street surface. Referring further to FIG. 2*b* and 3, it is seen that the lever 10 is biased upwardly by means of a leafspring 24. At the other side of bearing 11 which is attached to frame 15 is arranged a roll 12 which lies on a sloping surface 13. The sloping surface 13 is attached with the abutment 4 which is connected to carrier 18; the roll 12 rolls on surface 13 (see FIG. 2*b*) when the frame 15 encounters an obstacle and the frame turns on the element 36 with respect to the carrier 18. The flat brush 14 will be lowered to the surface by means of lever 10 by over-coming the force exerted by a spring leaf 24 (see FIG. 3) in order to push the rubbish forward until the frame and the brush cylinders return to their normal positions after passing the obstacles and the spring 21 pulls the frame 15 back to the abutment 4. The principle of the roll 12 and the sloping surface 13 is shown in FIG. 2*b* in an extended position which corresponds to the lifted position of the flat brush 14.

The brush cylinder 5 is flexibly supported from the frame 15 as is shown in FIG. 4. The cylinder 5 is carried by arm 38 which is attached on bearing 39 to the frame 15 in a linked fashion and which is provided with ball bearing 37. The arm 38 is biased by means of spring 41 upwardly; the spring is stretched between rail 42 attached to frame 15 and a toothed rack 40 which is attached to arm 38. By means of the various positions of the toothed rack 40, it is possible to vary the force which is exerted on the arm 38 and thereby adjust the pressure which the brush cylinder 5 exerts on the street surface. Screw 43, which serves the same purpose, is attached to a threaded rod which is attached to a spring 41. By means of the screw, the tension of the spring 41 can be adjusted. It is of particular importance in the device according to the invention that the brush cylinder be pressed against the surface with the proper amount of pressure since the carrying away of the dust from the surface must be carried out solely by means of the brushes as the device is not equipped with a vacuum device. The pressure is critical since this pressure must also be such as not to cause undue wear to the brushes.

In order to accomplish this proper adjustment of pressure, a special construction for the brush cylinder 5 is provided which is shown in FIG. 5. Slotted cylinder 5, is arranged about a drive shaft 1, the cylinder being divided by partitions 44 into a number of chambers 6 which correspond to the number of slots 6*a*. In each of the chambers 6 is arranged an adjustable brush roll 7 whose brush bundles are loosely bound together by bands 46. The brush bundles are releasably clamped by means of support 8 in slot 6*a* on the cylinder wall 45. When the brushes are worn, the brush support 8 can be loosened and the brush bundles pulled from the cylinder to replenish the lengths of the working end portions of the brush bundles.

FIG. 6 shows the rubbish removal means 50 for the large items of rubbish which lie on the surface to be cleaned as well as for the dust scales which have fallen from the water sack. This arrangement on the machine chassis 75 consists of a second revolving brush arrangement at an angle to the brush cylinder 5 of a cleaning arrangement like that shown in FIG. 1. A rubber surface 57 flap 58 leads to conveyor 60 which, in turn, leads to a second conveyor 61 and thence to a rubbish container (not shown). The second brush arrangement consists of two elements 49 which are located opposite to each other and which have an approximately bell-shaped cross-section, elements 49 containing two extensible brush bundles 68. The elements 49 are rotatably mounted about the brush axis 48 and run parallel to the driving axle 47 which maintains the element 49 in rotating movement. The extensible brush bundles 68 are clamped by means of a releasable holding means 8. The bell-shaped elements 49 are each closed by means of plate 51; attached by bolts 53 to plate 51 are weights 52. The weights tend to extend the elements 49 from the axis 47 during rotation. When the brushes 68 contact the surface to be cleaned, the bell-shaped elements 49 can be laterally swung out as it is shown in FIG. 6. Two leafsprings 54 serve as stopping means to prevent undue amounts of swinging. The two brush bundles 68 can be variously extended from the elements 49. One brush end 68*a* can be extended to a lesser extent than the other brush end 68*b*. The first brush end 68*a* to contact the surface to be cleaned is adapted to take up the larger items of rubbish such as cigarette packages and the second brush end 68*b* is adapted to sweep the dust scales which have fallen from the water sack. The direction of rotations is shown by the arrows. Rubber plate 57 which serves to take up the rubbish is supported by means of a hard rubber wedge 55, which wedge is easily replaceable by means of a wing-nut arrangement 56. Flap 58 which is arranged behind plate 57, leads the rubbish to the conveyor 60, the conveyor being led over axles 62. Conveyor 60 brings the material to a second conveyor 61 which in turn leads to a container (not shown). The second brush arrangement principally serves to take up the rubbish which comes from the two forward brush cylinders and to carry this material to the conveyor. In order to prevent the rubbish which is contacted by brushes 68*a* and 68*b* from flying about in an uncontrolled manner, shaped hood 63 with a rubber skirt hanging thereon is provided over the rubbish receiving means. The rubbish which strikes this hood 63 falls on the conveyor 60. The total arrangement is carried by a frame 65 and runs along a traveling wheel 59. Frame 15 of the cleaning arrangement and frame 65 of the receptacle arrangement 50 are both secured to and carried by the machine chassis 75.

A possible embodiment of the arrangement of brush cylinder and receiving means is shown in FIG. 7. The main cleaning brush cylinder 5 is driven by the same motor 17 which drives the second arrangement of brushes 68 by means of a belt which is led over roll 66.

The cylinder 5 is positioned at a slight angle so that the rubbish will be directed into a track and will be taken up by the removal means 50. The direction of movement of the total arrangement is shown by arrow C. The conveyor belt 60 is driven by a pulley 67 which is driven by a motor 17 and carries the rubbish which is taken up by the removal means 50. A chain 69 serves to transport the hard rubber wedge 55 which slides over the pavement. An electric or a hydraulic motor (or another appropriate arrangement can be used as driving means 17).

As previously mentioned, the machine according to the invention is particularly intended for pedestrian zones. The machine is also appropriate for the cleaning of side walks. In order to be able to travel on the sidewalk, the machine must be able to mount the curb. To this art, there is mounted on the forward end of the machine, a wheel arrangement, which arrangement is shown in FIG. 8. Three wheels are mounted in a row, the middle wheel 70 having a larger diameter than the other wheels 71. The wheels 71 are raised slightly from the surface of the pavement, the distance being approximately half the height of the curb 72, the middle wheel 70 then lifts the machine to the second half of the curb height. In this way, the traversing of curbs is made much easier than would be the case if only a single wheel were used. When the machine descends from a curb, the machine travels first from the middle wheel 70 to the rear wheel 71 before the middle wheel 70 reaches the lower street level. All the wheels are of the balloon type which further diminuishes undue shock. The same applies to the rear wheel arrangement (FIG. 9), which can be a single steering wheel 74, is also of the balloon type. Rear wheel steering allows the machine to be extremely maneuverable. FIG. 9*a* shows schematically the carrier 18 with the brush cylinders 5 in a withdrawn position. The carriers 18 are differently shaped so that the left and right side brush cylinders can be swung in front of each other. The cleaning machine according to the invention is therefore very narrow and is accordingly, adapted to clean narrow paths and can be kept in a small garage. In FIG. 9*a*, the rubbish removal means is generally shown by schematically indicating the second brush arrangement elements 49.

FIG. 9*b* shows schematically the carrier 18 and the brush cylinder 5 in an extended position.

FIG. 9*c* shows schematically the complete cleaning machine according to the invention with extended carriers traveling along a path containing obstacles 73. As can be seen, the brush cylinders 5 are turned with respect to the carrier 18 and adapt themselves to the locations of the obstacles. It is advantageous, for the carrier 18 to be lifted, e.g. hydraulically, in order that the machine can be driven when the cleaning mechanism is not in operation. The machine chassis itself can similarly be equipped with a cleaning arrangement 90 such as those carried by carrier 18 and shown in FIG. 1 in order that the middle of the street on which the machine is traveling can be cleaned. A cleaning arrangement 90 mounted on the middle and before the machine (as schematically illustrated by brush 5' in FIG. 9*a*) must be able to be separately liftable so that the machine will be able to mount curbs, and other obstacles. Such an embodiment is shown in FIG. 8, in which the frame 15 of a cleaning arrangement is mounted in a linked fashion on the machine frame 75 and which can be lifted and lowered by means of a hydraulic cylinder 78.

FIGS. 10*a* through 10*c* show another embodiment for a cleaning machine. This embodiment differs from those constructed in accordance with FIG. 2 in that the frames which carry the cleaning arrangement are carried by scissor arms which are attached to the chassis of the machine.

The scissor arms allow the cleaning arrangement to be extended to the left as well as to the right, the withdrawn position of the cleaning arms being shown in FIG. 10*a* and the extended positions in FIG. 10*b* and 10*c*.

FIG. 11 shows the details of this type of attachment. On the frame of the machine are attached scissor arms 82, the cleaning arrangement being attached to the free ends thereof. The only portion of the cleaning arrangement which is shown corresponds to that of FIG. 2. The ends of the scissor arms 82 on the side of the machine are attached to the slotted rail 80 which is attached to the frame 75. The piston rod 79 is moved by two hydraulically or pneumatically actuated cylinders 81. If the ends of scissor arms 82 are moved toward each other by the piston 79, then the scissor arms will be extended and the cleaning arrangement extended sidewardly from the cleaning machine.

Although a single such arrangement is shown in FIG. 11, it should be noted that another arrangement is intended for the other side of the machine. In all the embodiments, it is essential that the cleaning brushes have a good contact with the pavement surfaces.

Besides the separation of the drive shafts with the connection of a cross-link on universal joint 2 as shown in FIGS. 2 and 2*a*, it is also of importance that the suspension be flexible; a particularly flexible suspension is shown in FIG. 12. A link 83 is provided on carrier 18 so that the member 36 attached to this link 83 can freely swing. At right angles with respect to the first link 83 is a second link 37. Bearing bracket 84 is attached to the frame 15 of the cleaning arrangement by means of screw 85. In this manner, the frame 15 can freely swing in any direction with respect to the carrier 18. The free suspension of the frame 15 is promoted by a spring arrangement which consists of a spring 86 attached to the first bearing bracket 37, the spring having a projection 87 connecting to frame 15. The screw 85 allows a certain play between the second bearing bracket 84 and the frame 15.

The invention may be embodied in other specific forms without departing from the scope, spirit, or essential characteristics thereof. Present embodiments are, therefore, to be considered in all respects as illustrative and not restrictive, the scope and spirit of the invention being indicated by the appended claims rather than by the foregoing description and all changes which come within the meaning and range of equivalency of the claims are, therefore, intended to be embraced therein.

What is claimed and desired to be secured by Letters Patents is:

1. A street and pedestrian zone cleaning machine comprising: at least one sweeping mechanism arrangement comprising a brush cylinder with plural brushes rotatably mounted on the machine and adapted to sweep the surface to be cleaned, a permeable sack mounted on said machine extending closely adjacent the surface of said brush cylinder, said sack containing liquid maintaining a surface of said sack damp causing the dust swept by said brush cylinder to collect on said surface of said sack; a receptacle arrangement mounted on said machine adjacent one end of said brush cylinder so as to collect the scales of dust which fall from said surface of said sack, said receptacle arrangement including a brushing means and a means for receiving the material brushed by said brushing means; and said brushes of said brush cylinder being twisted in such a direction so as to cause the dust scales which fall from said sack to be swept in the direction of said receptacle arrangement.

2. The machine according to claim 1, wherein said sack is at least partially made from linen and in that said liquid is water.

3. The machine according to claim 1, wherein said receptacle arrangement includes a conveyor and a scoop means arranged between said brushing means and said receiving means.

4. The machine according to claim 3, wherein said scoop means includes a wedge-shaped sledging support.

5. The machine according to claim 4, wherein the brush cylinder and the water sack are enclosed by rubber skirts which reach to closely adjacent the surface to be cleaned.

6. The machine according to claim 1, wherein the brush cylinder is divided into at least two sections connected by a cross-link.

7. The machine according to claim 1, where a second cylinder is arranged in front of said brush cylinder for pressing larger items of rubbish against the surface being cleaned.

8. The machine according to claim 1, wherein said brush cylinder contains extensible rolls of brush material.

9. The machine according to claim 8, wherein said brushing means in said receptacle arrangement includes at least two bell-shaped receptors having extensible brushes therein.

10. A street and pedestrian zone cleaning machine comprising: at least one sweeping arrangement including a brush cylinder with plural brushes rotatably mounted on the machine and adapted to sweep the surface to be cleaned; a receptacle arrangement at one end of the brush cylinder; a liquid container having a liquid permeable cloth connected thereto, said liquid passing through said cloth thereby maintaining said cloth in a damp condition, said cloth being mounted on said machine closely adjacent said brush cylinder causing the dust swept by said brush cylinder to collect on said cloth, the brushes of said brush cylinder being twisted in such a direction so as to cause the dust scales which fall from said surface of said sack to be swept in the direction of said receptacle arrangement.

* * * * *